US007546074B2

(12) United States Patent
Oyama et al.

(10) Patent No.: US 7,546,074 B2
(45) Date of Patent: Jun. 9, 2009

(54) IMAGE FORMING APPARATUS

(75) Inventors: Hajime Oyama, Kanagawa pref (JP); Katsuhiro Echigo, Saitama pref (JP); Takahiro Tamiya, Tokyo (JP)

(73) Assignee: Ricoh Co., Ltd., Tokyo (JP)

( * ) Notice: Subject to any disclaimer, the term of this patent is extended or adjusted under 35 U.S.C. 154(b) by 258 days.

(21) Appl. No.: 11/687,360

(22) Filed: Mar. 16, 2007

(65) Prior Publication Data

US 2007/0217832 A1 Sep. 20, 2007

(30) Foreign Application Priority Data

Mar. 17, 2006 (JP) ..... 2006-073655

(51) Int. Cl.
*G03G 15/01* (2006.01)

(52) U.S. Cl. ..... 399/302; 399/121

(58) Field of Classification Search ..... 399/107, 399/121, 297, 298, 302, 303, 306, 308
See application file for complete search history.

(56) References Cited

U.S. PATENT DOCUMENTS

| | | | | |
|---|---|---|---|---|
| 6,778,794 | B2 * | 8/2004 | Kayahara | 399/129 |
| 6,963,715 | B2 * | 11/2005 | Kanekura et al. | 399/299 |
| 6,985,681 | B2 * | 1/2006 | Taguchi et al. | 399/66 |
| 7,298,997 | B2 * | 11/2007 | Hamada et al. | 399/296 |
| 2002/0034408 | A1 | 3/2002 | Motohashi | |
| 2006/0209151 | A1 | 9/2006 | Tamiya et al. | |
| 2007/0217832 | A1 | 9/2007 | Oyama et al. | |

FOREIGN PATENT DOCUMENTS

| | | |
|---|---|---|
| EP | 1 096 334 A2 | 5/2001 |
| EP | 0 825 496 | 9/2002 |
| EP | 1 109 078 B1 | 12/2004 |
| JP | 08-166728 | 6/1996 |
| JP | 9-160395 | 6/1997 |
| JP | 2000-298408 | 10/2000 |
| JP | 2001-66911 | 3/2001 |
| JP | 2002-014550 | 1/2002 |
| JP | 2002-72709 | 3/2002 |
| JP | 2003-76159 | 3/2003 |
| JP | 2004-144916 | 5/2004 |

OTHER PUBLICATIONS

U.S. Appl. No. 12/034,275, filed Feb. 20, 2008, Oyama, et al.

* cited by examiner

*Primary Examiner*—Hoan H Tran
(74) *Attorney, Agent, or Firm*—Oblon, Spivak, McClelland, Maier & Neustadt, P.C.

(57) ABSTRACT

An image forming apparatus includes at least one image forming unit, a primary transfer belt, and a secondary transferer. The image forming unit includes an image carrier and a primary transfer bias applicator. The secondary transferer includes a secondary transfer nip, a secondary transfer bias applicator, and a facing member facing the second transfer bias applicator. The secondary transfer bias applicator forms a secondary transfer electric field. The image forming apparatus further includes a bias applicator, a contact start site, and an electrode. The bias applicator applies a bias voltage having a same polarity as the normal charge polarity of the toner to the primary transfer belt, downstream of the primary transfer bias applicator. The recording medium starts to contact the toner image at the contact start site, located upstream of the secondary transfer nip, where the electrode forms an electric field.

9 Claims, 12 Drawing Sheets

IMAGE FORMING APPARATUS

BACKGROUND OF THE INVENTION

1. Field of the Invention

The present invention relates to an image forming apparatus, and more particularly to a color image forming apparatus employing an intermediate transfer method.

2. Discussion of the Background

Recently, demand for color image forming apparatuses, such as color copiers and color printers, has been increasing in the image forming apparatus market.

An electronographic color image forming apparatus can employ a tandem method. A tandem image forming apparatus includes a plurality of image carriers (e.g. photoreceptors) that are accompanied by an image developer of each color. On each of the image carriers, an electrostatic latent image of single color is formed and developed into a toner image with toner.

In case of an intermediate transfer method, the image forming apparatus further includes an intermediate transfer belt, a primary transferer, and a secondary transferer. The single color images can be transferred and superimposed on the intermediate transfer belt one on another by the primary transferer with Coulomb's force due to a primary transfer electric field to form a synthesized color image. The color image (toner image) is then transferred onto the recording medium by the secondary transferer with Coulomb's force due to a secondary transfer electric field.

The primary and secondary transfer electric fields are formed to desirably act in a transfer nip where the photoreceptor and the intermediate transfer belt or the intermediate transfer belt and the recording medium are in close contact with only toner also being present. Otherwise, a discharge phenomenon is likely to occur, which can deteriorate image quality.

For example, if the electric field acts upstream of the transfer nip, the toner on the intermediate transfer belt can scatter onto the intermediate transfer belt or the second medium (pre-transfer scattering). Further, the toner previously transferred on the intermediate transfer belt can be transferred onto the image carrier during transfer of a second toner image and subsequent toner images (reverse transfer).

Fluctuation of a charge amount of toner can cause the toner scattering and the reverse transfer. The fluctuation can be caused by ion migration due to discharge and charge transfer caused by electrostatic induction in or near the primary transfer nip.

The above problems can be reduced by decreasing the transfer bias voltage. However, the toner transfer rate may decrease and the amount of toner that fails to be transferred (remaining toner) may increase when the transfer bias voltage is reduced and becomes insufficient. Because of these problems, a need exists to limit the electrostatic induction phenomenon and to reduce discharge to desirable levels so as to obtain desirable image quality.

To achieve the above, an exemplary image forming apparatus can include an image carrier, an intermediate transfer belt, a primary transferer, a secondary transferer, a first contact member, and a potential maintaining member. After passing by the primary transferer, the intermediate transfer belt next contacts the first contact member whose surface potential can be maintained not less than the charge potential of a back surface of the intermediate transfer belt by the potential maintaining member. Alternatively, the image forming apparatus can include a bias applicator to maintain the level of surface potentials of all components that the intermediate transfer belt contacts after the primary transferer up to the secondary transferer. The level is maintained to be not less than the charge potential of the back surface of the intermediate transfer belt.

Another exemplary image forming apparatus can include an image carrier, an intermediate transfer belt, an electrostatic transfer member, a pre-transfer prevention member, and a remaining toner transfer prevention member. The electrostatic transfer member, the pre-transfer member, and the remaining toner transfer prevention member can be provided at an opposite side of the image carrier with respect to the intermediate transfer belt. The electrostatic transfer member can generate an electric field to transfer a toner image from the image carrier onto the intermediate transfer belt.

The pre-transfer prevention member can be provided upstream of the electrostatic transfer member and the remaining toner transfer prevention member can be provided downstream of the electrostatic transfer member in a rotation direction of the intermediate transfer belt. A bias voltage of the same polarity as the polarity of the toner can be applied to the pre-transfer prevention member and the remaining toner transfer prevention member.

SUMMARY OF THE INVENTION

Various exemplary embodiments disclosed herein describe an image forming apparatus.

In one exemplary embodiment, an image forming apparatus includes at least one image forming unit, a primary transfer belt, and a secondary transferee. The image forming unit includes an image carrier on which a toner image is formed and a primary transfer bias applicator to apply a bias voltage having an opposite polarity to a normal charge polarity of the toner, to the primary transfer belt to transfer the toner image from the image carrier to the primary transfer belt. The primary transfer belt forms a primary transfer nip with the image carrier. The secondary transferer includes a secondary transfer nip, a secondary transfer bias applicator, and a facing member facing the second transfer bias applicator. The secondary transfer nip is configured to contact the toner image on the primary transfer belt through a recording medium. The secondary transfer bias applicator forms a secondary transfer electric field to transfer the toner image on the primary transfer belt onto the recording medium. The image forming apparatus further includes a bias applicator, a contact start site, and an electrode. The bias applicator applies a bias voltage having a same polarity as the normal charge polarity of the toner to the primary transfer belt, in a position downstream of the primary transfer bias applicator. The recording medium starts to contact the toner image at the contact start site, located upstream of the secondary transfer nip. The electrode forms an electric field at the contact start site to increase an electrostatic attraction between the primary transfer belt and the toner having the normal charge polarity.

BRIEF DESCRIPTION OF THE DRAWINGS

Features and attendant advantages of the invention will be more fully appreciated, as the same becomes better understood from the detailed description when considered in connection with the accompanying drawings, wherein.

DETAILED DESCRIPTION OF THE INVENTION

Figure 1:
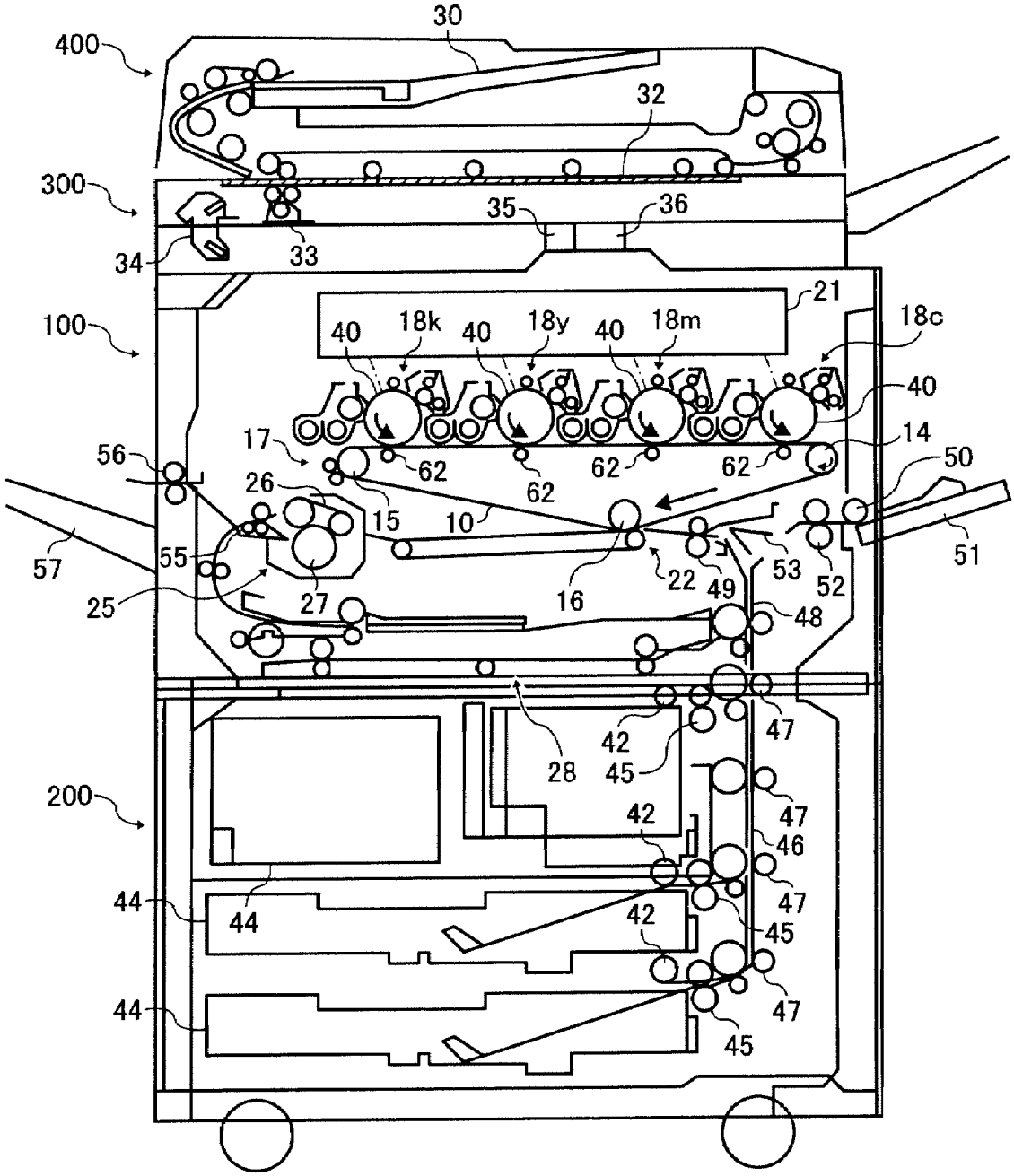
FIG. 1 is an illustration of a tandem image forming apparatus employing an intermediate transfer method according to an exemplary embodiment.

The exemplary embodiments provide an image forming apparatus that will reduce toner scattering and reverse transfer during a primary transfer process and a secondary transfer process.

Having generally described this invention, further understanding can be obtained by reference to the specific exemplary embodiments that are provided herein for the purpose of illustration only and are not intended to be limiting. It is to be understood that each specific element includes all technical equivalents that operate in a similar manner.

Referring now to the drawings, wherein like reference numerals designate identical or corresponding parts throughout the several views, an image forming apparatus 100 according to an exemplary embodiment is described.

Referring to FIG. 1, the image forming apparatus 100 can be a tandem type image forming apparatus. The image forming apparatus can be placed on a sheet feeder 200 storing sheets as recording mediums. A scanner 300 can be provided over the image forming apparatus 100, and an automatic document feeder (ADF) 400 can be provided over the scanner 300.

The image forming apparatus 100 includes an intermediate transfer belt 10, a support roller 14, a support roller 15, a facing roller 16, an intermediate transfer cleaner 17, image forming units 18*k*, 18*y*, 18*m*, and 18*c*, and an irradiator 21. Each of the image forming units 18*k*, 18*y*, 18*m*, and 18*c* includes a photoreceptor 40 that is an image carrier.

The intermediate transfer belt 10, which is a primary transfer belt, may be an endless belt and can be placed at a center of the image forming apparatus 100. The intermediate transfer belt 10 can be rotated clockwise in FIG. 1, and can be stretched around the support rollers 14 and 15 and the facing roller 16. As an exemplary embodiment, the intermediate transfer cleaner 17 is placed at the left of the support roller 15 as seen in FIG. 1.

The image forming units 18*k*, 18*y*, 18*m*, and 18*c* can form black, yellow, magenta, and cyan images, respectively, and can be laterally arranged on a front surface of the intermediate transfer belt 10 along its rotation direction. The irradiator 21 can be provided over the image forming units 18*k*, 18*y*, 18*m*, and 18*c*, and can apply light to the photoreceptors 40 to form electrostatic latent images of respective colors.

The image forming apparatus 100 can further include a secondary transferer 22, a fixer 25, a sheet reverser 28, a sheet feeding path 48, a pair of registration rollers 49, a switch claw 55, a pair of ejection rollers 56, and an ejection tray 57.

The fixer 25 can include an endless fixing belt 26, a pressing roller 27, and a heat source (not shown), and can be placed at a side of the secondary transferer 22. The sheet reverser 28 can be provided in parallel to the image forming units 18*k*, 18*y*, 18*m*, and 18*c* beneath the secondary transferer 22 and the fixer 25. The sheet reverser 28 can reverse the sheet so that images are recorded on both surfaces of the sheet.

The sheet feeder 200 can include a plurality of feeding rollers 42, a plurality of sheet cassettes 44, a plurality of separation rollers 45, a sheet feeding path 46, and a plurality of conveyance rollers 47. The sheet feeder 200 can further include a feeding roller 50, a manual feed tray 51, a pair of separation rollers 52, and a manual feeding path 53.

The scanner 300 can include a contact glass 32, a first carriage 33, a second carriage 34, an imaging lens 35, and a reading sensor 36. The first carriage 33 can include a light source. The second carriage 34 can include a mirror. The ADF 400 includes a document table 30.

Processes to read an original document by the scanner 300 for copying are described. An operator can place an original document on the document table 30. Alternatively, the operator can open the ADF 400, place the original document on the contact glass 32 of the scanner 300, and close the ADF 400 to hold the original document with the ADF 400.

When the operator pushes a start button (not shown), the original document on the document table 30 is forwarded onto the contact glass 32. Alternatively, when the original document is place on the contact glass 32, the scanner 300 immediately starts to run the first carriage 33 and the second carriage 34. The light source of the first carriage 33 emits light to the original document. The light is reflected by a surface of the original document. The reflected light is further reflected and sent to the second carriage 34. In the second carriage 34, the reflected light is reflected by the mirror and sent to the reading sensor 36 through the imaging lens 35. Thus, the reading sensor 36 reads image information on the original document.

The intermediate transfer belt 10 is described in detail. Desirably, the intermediate transfer belt 10 is relatively non-elastic to prevent expansion and/or contraction of images. The intermediate transfer belt 10 may be a single-layered belt.

The intermediate transfer belt 10 may include a single-layered polyimide as a base. Known thermoplastic resins including thermoplastic resins and thermosetting resins may be used for the intermediate transfer belt 10. Examples of the resins include poly vinylden fluoride (PVDF), ethylene-tetrafluoroethylene copolymer (ETFE), polycarbonate (PC), a polyester resin, a polyamide resin, a polyurethane resin, a polyether resin, and a polyvinyl resin. A conductive material may be dispersed in the above resin to adjust its electrical resistance.

The intermediate transfer belt 10 desirably has a volume resistivity within a range from $10^7$ ohms centimeter (Ωcm) to $10^{13}$ Ωcm under a condition that a bias voltage of 1 kV is applied during a primary transfer process. A back surface of the intermediate transfer belt 10 desirably has a surface resistivity (ρs) within a range from $10^8$ ohms per square (Ω/sq) to $10^{12}$ Ω/sq. The surface resistivity within a range from $10^9$ Ω/sq to $10^{11}$ Ω/sq is more desirable. A flexible, thin layer having a thickness within a range from 50 μm to 200 μm is desirable. The surface resistivity of the back surface means a resistance per unit area (e.g. per square centimeter) on the surface being in contact with a bias applicator. The resistivity can be measured under conditions that a main electrode has an outer diameter of 5.9 mm, a guard electrode has an inner diameter of 11.0 mm and an outer diameter of 17.8 mm, and a voltage of 500 V is applied.

As described above, a conductive material may be used to adjust the electrical resistivity of the intermediate transfer belt 10. Examples of conductive materials include metal powders, metal oxides, boron-containing high polymers, and conductive high polymers. Examples of metal powders include carbon, aluminum, and nickel. An example of the metal oxide is titanium oxide. Examples of conductive high polymers include quaternary ammonium salt containing polymethyl methacrylate, polyvinyl aniline, polyvinylpyrrol, polydiacetylene, polyethyleneimine, boron-containing high polymers, and polypyrrol. One of the above or a combination of the above materials may be used as the conductive material.

Processes to form an image by the image forming apparatus 100 are described. When the operator pushes the start button (not shown), a driving motor (not shown) drives one of the support rollers 14 and 15 and the facing roller 16 to rotate. Accordingly, the other two rollers are driven to rotate and the intermediate transfer belt 10 is rotated. Simultaneously, the photoreceptors 40 in the image forming units 18*k*, 18*y*, 18*m*, and 18*c* are rotated and single color images of black, yellow, magenta, and cyan are formed on the corresponding respective photoreceptors 40. The image forming processes are described in detail later. Along with the rotation of the intermediate transfer belt 10, the single color images are transferred onto the intermediate transfer belt 10 in order (primary transfer), and a synthesized color image is formed thereon.

In the sheet feeder 200, one of the feeding rollers 42 is selected when the operator pushes the start button (not shown). The feeding roller 42 rotates to send a sheet from a corresponding sheet cassette 44. A pair of separation rollers 45 corresponding to the feeding roller 42 separate and send the sheets one by one to the feeding path 46. The conveyance rollers 47 convey the sheet along the sheet feeding path 48 in the image forming apparatus 100.

Alternatively, the feeding roller 50 can rotate to send out a sheet from the manual feed tray 51. The pair of separation rollers 52 can separate the sheets to send out the sheets one by one. The sheet is then conveyed through the manual feeding path 53.

The pair of registration rollers 49 can stop the sheet by sandwiching a leading edge of the sheet therebetween. The pair of registration rollers 49 rotate in synchronization with the synthesized color image on the intermediate transfer belt 10. The sheet passes between the intermediate transfer belt 10 and the secondary transferer 22 so that the secondary transferer 22 transfers the color image onto the sheet.

The secondary transferer 22 conveys the sheet to the fixer 25 after transferring the image. The sheet passes between the fixing belt 26 and the pressing roller 27 in the fixer 25, and the image transferred on the sheet can be fixed with heat and pressure. After the fixing process, the switch claw 55 can switch directions to send the sheet to the pair of ejection rollers 56, or to the sheet reverser 28. The sheet reverser 28 can reverse the sheet and send the sheet to the secondary transferer 22 to form an image on a back surface of the sheet. The pair of ejection rollers 56 ejects the sheet onto the ejection tray 57.

After the image is transferred from the intermediate transfer belt 10 onto the sheet, the intermediate transfer cleaner 17 removes any toner remaining on the intermediate transfer belt 10. The intermediate transfer belt 10 is prepared for a next image formation by image forming units 18*k*, 18*y*, 18*m*, and 18*c*.

The registration rollers 49 can be conductive rubber rollers. A bias voltage can be applied to the registration rollers 49 to remove paper dust and debris from the surface of the sheet and to charge the surface of the sheet. The pre-transfer scattering of toner can be reduced by charging the surface of the sheet to a same polarity as a polarity of toner before the transfer process.

An outer layer of the registration rollers 49 can be formed of conductive nitrile-butadiene rubber (NBR) having a volume resistivity of about $10^9$ Ωcm and a thickness of about 1 mm. A voltage of about −850 V may be applied to the surface of the sheet on which the toner is transferred. A voltage of about +200 V can be applied to the back surface of the sheet. Alternatively, the back surface of the sheet can be grounded if it is not necessary to consider transfer of paper dust or debris. Although a direct current (DC) bias voltage is applied in an exemplary embodiment, alternating current having a DC offset element can be used.

A DC bias voltage on which AC is superposed can charge the surface of the sheet more uniformly. After the sheet passes the registration rollers 49, the surface of the sheet will be slightly negatively charged. Therefore, when voltage is applied to the registration rollers 49, an optimum transfer condition to transfer the image from the intermediate transfer belt 10 onto the sheet can change. In that case, adjustment of the transfer condition may be required.

Figure 2:
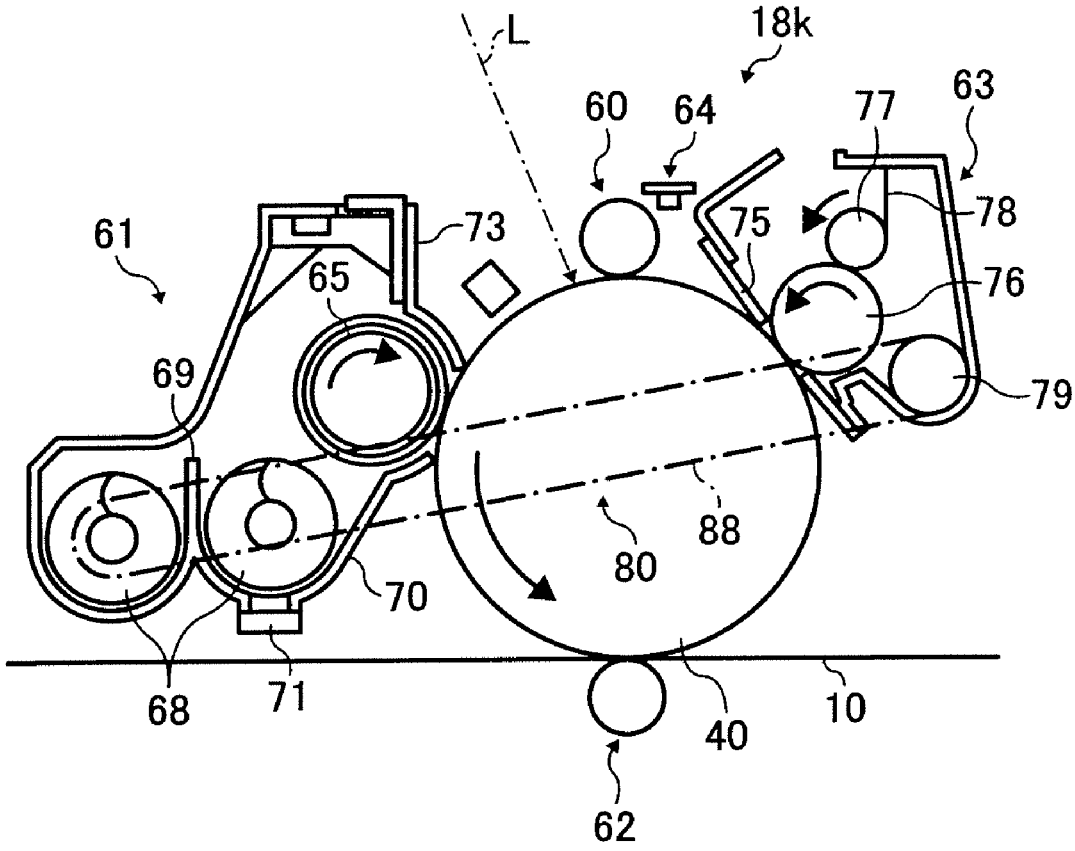
FIG. 2 is an illustration of an image forming unit included in the image forming apparatus of FIG. 1.

Referring to FIG. 2, the image forming unit 18*k* is described. The image forming units 18*k*, 18*y*, 18*m*, and 18*c* have a similar configuration. The image forming unit 18*k* includes a charger 60, a developing unit 61, a primary transferer 62, a photo receptor cleaner 63, a discharger 64, and a toner recycling device 80 around the photoreceptor 40. Along with a rotation of the photoreceptor 40, the charger 60 contacts and uniformly charges the photoreceptor 40. Next, the irradiator 21 (FIG. 1) applies light L, such as a laser or LED, to the photoreceptor 40 based on the image information read by the scanner 300 (FIG. 1) to form the electrostatic latent image as an exposure process. The developing unit 61 develops the electrostatic latent image on the photoreceptor 40 into a visible toner image. The primary transferer 62 transfers the toner image onto the intermediate transfer belt 10. Next, the photoreceptor cleaner 63 cleans the surface of the photoreceptor 40 and the discharger 64 initializes a surface potential thereon.

The photoreceptor 40 can be a drum on which a photosensitive layer is formed. For example, an organic sensitizer having photosensitivity can be applied to an aluminum drum to manufacture the photoreceptor 40. Alternatively, the photoreceptor 40 can be an endless belt. The photoreceptor 40 and at least one of the other components in the image forming unit 18*k* can be integrated as a process cartridge that is attachable to and detachable from the image forming apparatus 100 as a unit to facilitate maintenance. The charger 60 can be a roller to which a voltage is applied.

The developing unit 61 can use a two-component developer including a magnetic carrier and a nonmagnetic toner for developing the electrostatic latent image. Alternatively, a one-component developer can be used. The developing unit 61 can include an agitation area, a developing area, a developing sleeve 65, a pair of screws 68, a partition 69, a case 70, a toner density sensor 71, and a doctor blade 73. A position of the agitation area, which includes the pair of screws 68 placed laterally in parallel, can be lower than a position of the developing area, which includes the developing sleeve 65. The partition 69 can be placed between the screws 68 to separate the agitation area, except for portions near a ceiling and a bottom. The pair of screws 68 can agitate and send the two-component developer to the developing area. The developer can adhere on the developing sleeve 62. The toner is then transferred from the developer on the developing sleeve 65 to the photoreceptor 40.

A cartridge case (not shown) may be provided at an edge of the developing unit 61. One of the screws 68 is contained in the cartridge case. The case 70 houses the developing area and the agitation area. The toner density sensor 71 is provided on the case 70. The case 70 includes an opening through which the developing sleeve 65 faces the photoreceptor 40 and forms a developing gap therebetween. The doctor blade 73 is placed so that its edge is close to the developing sleeve 65. A distance between the doctor blade 73 and the developing sleeve 65 may be 500 μm where the doctor blade 73 is closest to the developing sleeve 65.

The developing sleeve 65 can be a rotatable nonmagnetic sleeve. The developing sleeve 65 can include a plurality of magnets. Because the magnets are fixed in the developing sleeve 65, magnetism can affect the developer passing a predetermined or desirable position.

In an exemplary embodiment, the developing sleeve 65 has a diameter of 18 mm. A surface of the developing sleeve 65 can be sandblasted. Alternatively, a plurality of grooves having a depth within a range from 1 millimeter to a few millimeters can be formed on the surface of the developing sleeve 65. The surface roughness of the developing sleeve 65 can be within a range from 10 μm to 30 μm as a ten-point mean roughness (Rzjis).

The toner can have a predetermined or desirable charge amount by being mixed with the magnetic carrier.

The pair of screws 68 can agitate and circulate the two-component developer, and supply the two-component developer to the developing sleeve 65. Magnetism from the plurality of magnets will draw up and keep the developer including the toner and the magnetic carrier (magnetic particles) on the developing sleeve 65. The developer can form a magnetic brush on the developing sleeve 65. While the developing sleeve 65 rotates, the doctor blade 73 can cut the magnetic brush to a desirable amount and remove excessive developer. The removed developer is sent back to the agitation area.

A Developing bias voltage can be applied to the developing sleeve 65 and the toner in the two-component developer can be transferred from the developing sleeve 65 to the photoreceptor 40 to develop the electrostatic latent image on the photoreceptor 40. After the image is developed, the developer remaining on the developing sleeve 65 leaves the developing sleeve 65 at an area where the magnetism from the magnets is not present, and return to the agitation area. Thus, the developer can be circulated. As the circulation is repeated, a density of the toner can decrease. When the toner density sensor 71 senses the decrease in toner density, more toner is supplied to the agitation area.

In an exemplary embodiment, the photoreceptor 40 can rotate at a linear speed of 200 mm per second and has a diameter of 50 mm. The developing sleeve 65 can rotate at a linear speed of 240 mm per second and has a diameter of 18 mm. A preferable toner charge amount can be within a range from −10 micro-coulombs per gram (μC/g) to −30 μC/g on the developing sleeve 65. The developing gap, which is a space between the photoreceptor 40 and the developing sleeve 65, can be set within a range from 0.8 mm to 0.3 mm. To insure accuracy, a tolerance is kept within plus/minus 0.03 mm. Developing efficiency can be enhanced by narrowing the developing gap. If accuracy is maintained within plus/minus 0.01 mm, the developing gap can be set to about 0.1 mm.

The photosensitive layer of the photoreceptor 40 can have a thickness of 30 μm. The light L from the irradiator 21 can have a light amount of 0.47 mW and can be focused to a beam spot having a diameter of 50×60 μm on the photoreceptor 40. The photoreceptor 40 can have a charge potential of −700 V before exposure process ($V_0$) and a charge potential of −120 V after exposure process ($V_L$). The developing process can be performed under a developing bias voltage of −470 V, that is, a developing potential of 350 V.

The primary transferer 62 can include a roller-shaped bias applicator and can be placed at a position to press the photoreceptor 40 via the intermediate transfer belt 10. Alternatively, the bias applicator may be a blade, a brush, or a non-contact corona charger.

The photoreceptor cleaner 63 can include a cleaning blade 75, a conductive fur brush 76, an electrolytic roller 77, a scraper 78, and a collecting screw 79. The cleaning blade 75 can be formed of a polyurethane rubber and its edge is in contact with the photoreceptor 40. When a tip of the fur brush 76 is rubbed with the surface of the photoreceptor 40, the fur brush 76 and the photoreceptor 40 can rotate or move in counter directions relative to each other. The electrolytic roller 77 can be formed of a metal. When a tip of the fur brush 76 is rubbed with the electrolytic roller 77, the electrolytic roller 77 and the fur brush 76 can rotate or move in directions counter to each other. The electrolytic roller 77 applies a bias voltage to the fur brush 76 to remove the toner on the fur brush 76. An edge of the scraper 78 is pressed to the electrolytic roller 77 to clean the electrolytic roller 77. The collecting screw 79 collects the removed toner.

The fur brush 76 can remove the toner remaining on the photoreceptor 40. The electrolytic roller 77 applies the bias voltage to the fur brush 76 to remove the toner adhering to the fur brush 76, while rotating in contact with the fur brush 76. The collecting screw 79 can collect the removed toner and move it to a side of the photoreceptor cleanser 63. Further, the toner recycling device 80 can return the removed toner to the developing unit 61 for recycling.

The discharger 64 can be a lamp, for example, that applies light to the photoreceptor 40 to initialize a surface potential thereon as a preparation for forming a next image.

Next, the toner recycling device 80 is described. Although details are not shown, the toner recycling device 80 can include a toner conveyance case 88 in which a toner conveyance belt (not shown) and a rotation shaft (not shown) can be provided. A plurality of blades (not shown) can be attached on an outer circumference of the toner conveyance belt at substantially constant intervals. The toner conveyance case 88 can extend from the developing unit 61 to the photoreceptor cleaner 63. A roller (not shown) can be provided on one edge of the collecting screw 79 of the photoreceptor cleanser 63 and one end of the toner conveyance belt can be stretched around the roller. The other end of the toner conveyance belt can be stretched around the rotation shaft placed at a side near developing unit 61. The toner conveyance case 88 can be united with the cartridge case of the developing unit 61.

A driving force from outside can rotate the collecting screw 79, which causes the toner conveyance belt to rotate. The toner conveyance belt conveys the toner collected by the photoreceptor cleaner 63 through the toner conveyance case 88. The screw 68 may forward the toner into the developing unit 61. In the developing unit 61, the toner is mixed with the developer that previously exists in the developing unit 61 and conveyed to the developing sleeve 65. The developer is cut by the doctor blade 73 to a desirable amount and transferred to the photoreceptor 40.

Figure 3:
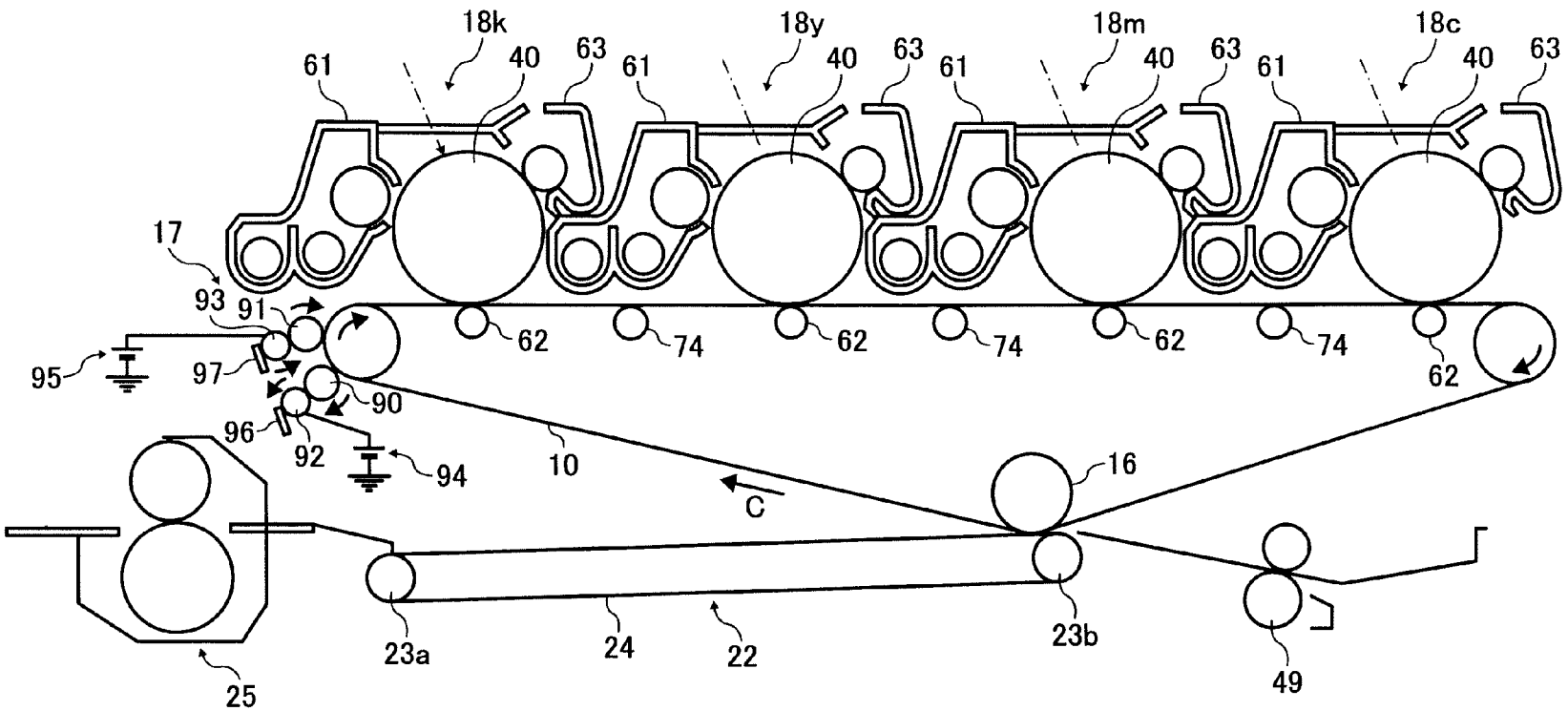
FIG. 3 is an enlarged illustration of a main part of the image forming apparatus of FIG. 1.

FIG. 3 illustrates a main part of the image forming apparatus 100. In the following description, "upstream" and "downstream" mean a relative position in the rotation direction of the intermediate transfer belt 10, unless otherwise stated.

The image forming apparatus 100 can further include a plurality of rollers 74. The rollers 74 can be placed along the back surface of the intermediate transfer belt 10, between the primary transferers 62. The rollers 74 can rise to contact the back surface of the intermediate transfer belt 10 and can help to form primary transfer nips required by the primary transferers 62. The primary transfer nips are contact areas between the photoreceptors 40 and the intermediate transfer belt 10.

The secondary transferer 22 can include a roller 23*a*, a bias applying roller 23*b*, and a secondary transfer belt 24. The secondary transfer belt 24 can be an endless belt stretched between the roller 23*a* and the bias applying roller 23*b* and can be pressed to the facing roller 16 via the intermediate transfer belt 10.

The secondary transferer 22 can further function to convey the sheet to the fixer 25 after a secondary transfer process. Alternatively, the secondary transferer 22 may be a noncontact charger, in which case it may be difficult to add the sheet conveyance function to the secondary transferer 22.

The intermediate transfer cleaner 17 can include fur brushes 90 and 91 as cleaning members, metal rollers 92 and 93, power sources 94 and 95, and blades 96 and 97. The fur brushes 90 and 91 can rotate in a counter direction with respect to the intermediate transfer belt 10 while contacting the intermediate transfer belt 10.

The fur brushes 90 and 91 can have a diameter of 20 mm and include an acrylic carbon fiber having a thickness of 6.25 deniers per filament. The fur brushes 90 and 91 can have a brush density of 100,000 fibers per square inch and a resistivity of $1.0\times10^7\Omega$. A bias voltage of different polarity can be applied to each of the fur brushes 90 and 91 from a power source (not shown).

The metal rollers 92 and 93 can rotate in directions similar to the rotation direction of fur brushes 90 and 91 while contacting the fur brushes 90 and 91, respectively. The fur brush 90 and the metal roller 92 are upstream of the fur brush 91 and the metal roller 93 in rotation direction of the intermediate transfer belt 10 shown as arrow C in an exemplary embodiment illustrated in FIG. 3. The power source 94 can apply a negative voltage to the metal roller 92. The power source 95 can apply a positive voltage to the metal roller 93. Edges of the blades 96 and 97 can be pressed to the metal rollers 92 and 93, respectively.

Along with the rotation of the intermediate transfer belt 10 in the direction of arrow C, a negative bias voltage can be applied to the upstream metal roller 92 so that the fur brush 90 can clean the surface of the intermediate transfer belt 10. For example, when a bias voltage of −700 V is applied to the metal roller 92, the fur brush 90 will have a potential of −400 V. The toner on the intermediate transfer belt 10, which is anodic, can be transferred onto the fur brush 90. The toner can be further transferred to the metal roller 92 due to the potential difference and removed by the blade 96.

After the cleaning by the fur brush 90, toner may still remain on the surface of the intermediate transfer belt 10. The remaining toner is negatively charged due to the negative bias voltage applied to the fur brush 90. The toner can be charged by charge injection and/or discharge.

Next, a positive bias voltage can be applied to the downstream metal roller 93 and the fur brush 91 can clean the surface of the intermediate transfer belt 10. Therefore, the remaining toner can be removed. The removed toner can be transferred to the metal roller 93 from the fur brush 91 and removed by the blade 97.

The toner removed by the blades 96 and 97 can be collected in a tank (not shown). Alternatively, the toner recycling device 80 can send the toner to the developing unit 61.

Although the fur brush 91 can remove a substantial amount of toner, a tiny amount of toner may remain on the surface of the intermediate transfer belt 10. The remaining toner is positively charged due to the positive bias voltage applied to the fur brush 91. The remaining toner can be reversely transferred to the photoreceptor 40 in the image forming unit 18*k* at a primary transfer position of black toner. The photoreceptor cleaner 61 can collect the toner.

Next, the developer including the toner and the magnetic carrier is described.

The toner may include a resin, for example, polyester, polyol, oracrylicstyrene. A charge control agent and a colorant may be mixed with the resin. At least one additive, for example, silica and/or titanium oxide, may be added to the surface of the particles of the mixture. Thus, the toner may have an enhanced charging characteristic and an enhanced fluidity. The additive may have a particle size within a range from 0.1 μm to 1.5 μm. Examples of colorant include carbon black, phthalocyanine blue, quinacridone, and carmine. A charge polarity of toner is negative, as an exemplary embodiment.

Alternatively, a mother toner particle may be produced by dispersively mixing wax and etc., for example. At least one of the above additives may be added to the mother toner particle. The toner described above may be produced by a grinding method. Alternatively, the toner produced by a polymerization method may be used. In general, a toner produced by a polymerization method or a heating method has a shape factor greater than 90 percent and an extremely higher degree of coverage of the additive because of the shape.

A shape factor $SF_1$ (percentage) is defined as sphericity under normal circumstances and is calculated by:

$$SA_1/SA_2\times100$$

wherein $SA_1$ is a surface area of a sphere that has a similar volume and $SA_2$ is a surface area of an actual particle.

However, a shape factor $SF_2$ (percentage) defined as roundness is used in an exemplary embodiment because measurement of an actual particle is difficult. The shape factor $SF_2$ is calculated by:

$$CL/OL\times100$$

wherein CL is a circumference length of a circle having a similar projected area to a projected area of the actual particle and OL is an outline length of the projected area of the actual particle. The shape factor $SF_2$ closes to 100 percent as the projected outline of the actual particle becomes more round. The toner desirably has a volume average particle size within a range from 3 μm to 12 μm. In an exemplary embodiment, the toner has a volume average particle size of 6 μm that can provide a high quality image having a resolution of 1200 dpi or more.

The magnetic carrier can include a magnetic material, for example, ferrite, as a core whose surface is coated with a silicon resin, for example. The magnetic carrier desirably has a particle size within a range from 20 μm to 50 μm and a dynamic resistivity within a range from $10^4\Omega$ to $10^6\Omega$. The dynamic resistivity is measured under conditions when the magnetic carrier is kept on a roller having a magnet, an electrode is closely placed to have a gap of 0.9 mm between the roller and the electrode, and a voltage of upper limit level is applied to the magnetic carrier. The roller has a diameter of 20 mm and rotates at a speed of 600 revolutions per minute (rpm). The electrode has a width of 65 mm and a length of 1 mm.

When the magnetic carrier is coated with silicon having a high resistivity, the upper limit voltage is 400 V. When the magnetic carrier is iron powder, the upper limit voltage is a few volts.

Figure 4A:
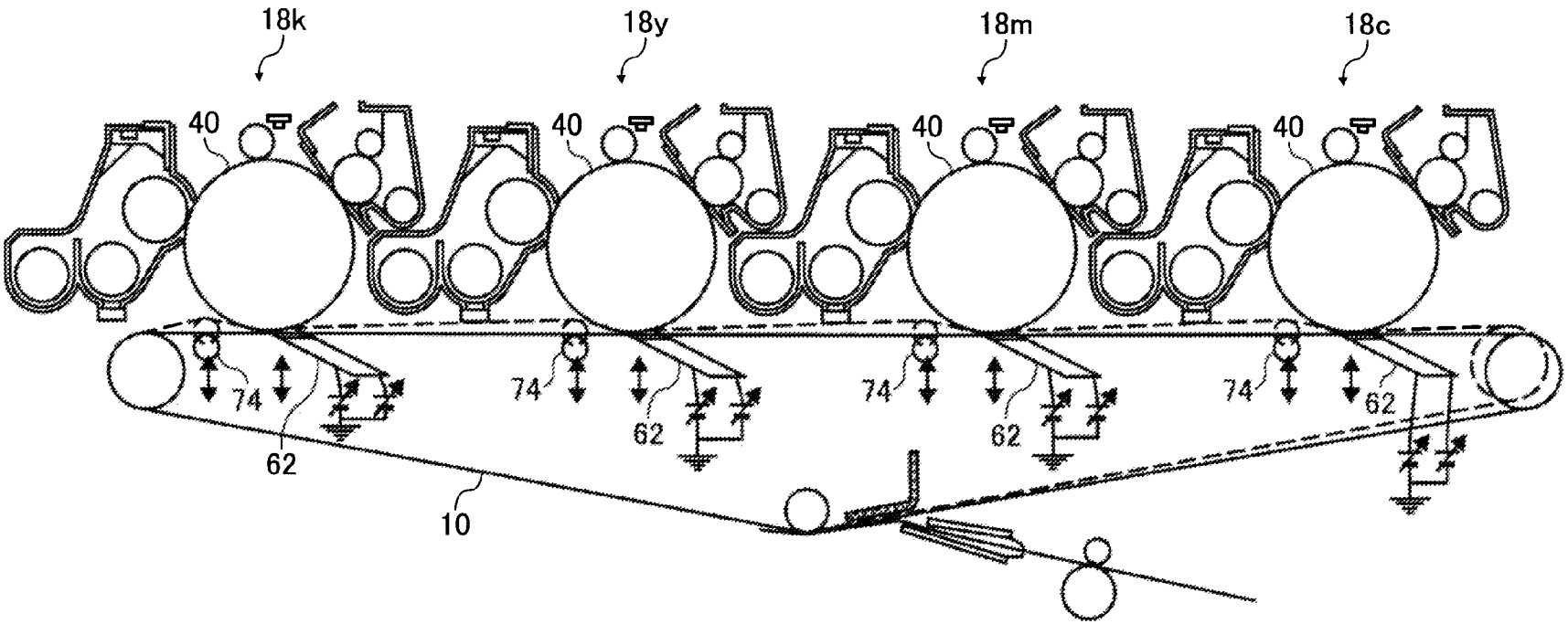
FIG. 4A is an illustration to explain rollers to form primary transfer nips according to an exemplary embodiment.
Figure 4B:
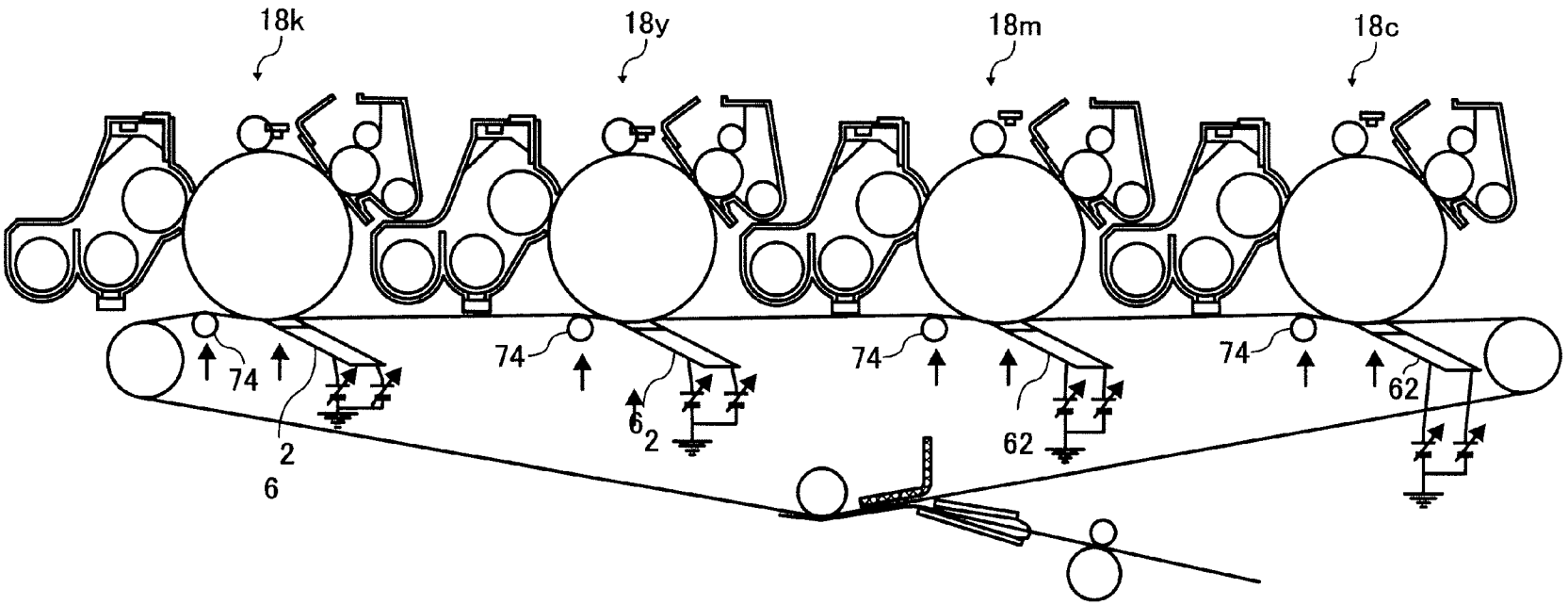
FIG. 4B illustrates a state in which the rollers are in upper positions to form the primary transfer nips.
Figure 4C:
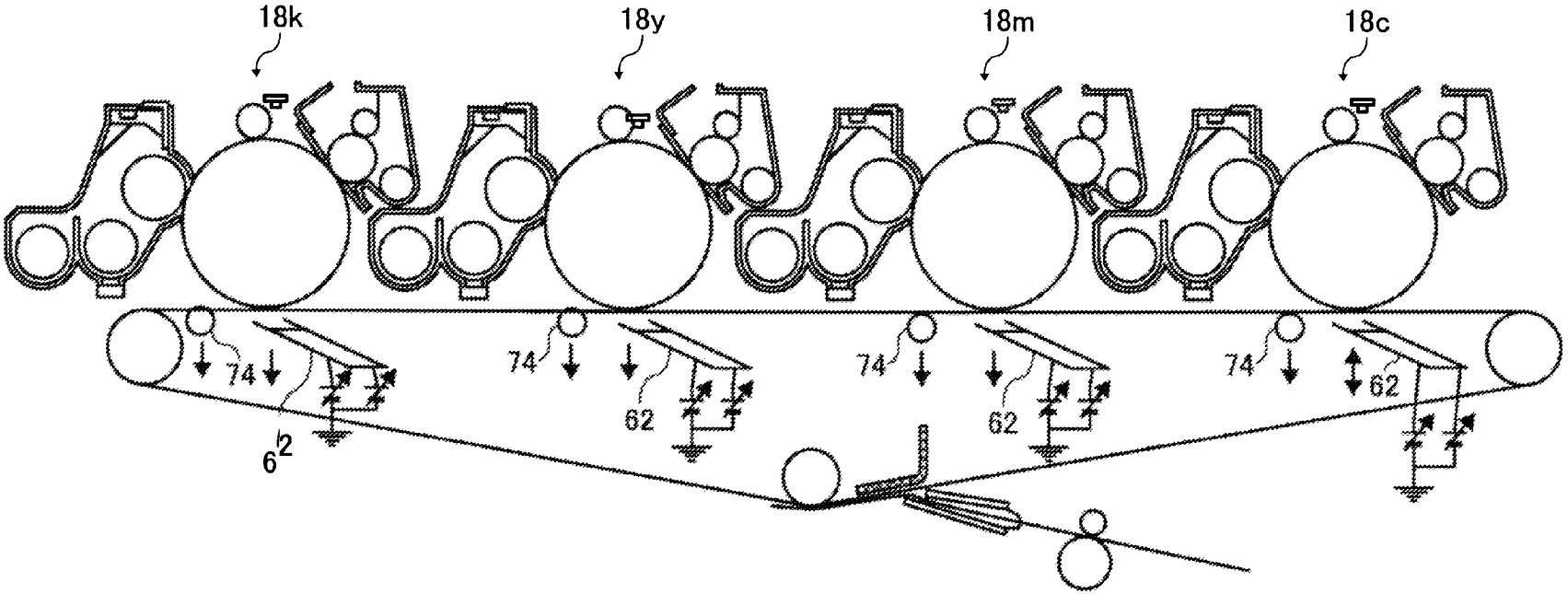
FIG. 4C illustrates a state in which the rollers are in lower positions.

Referring to FIGS. 4A, 4B, and 4C, the rollers 74 are further described. The rollers 74 are movable between lower positions shown in full lines and upper positions shown in dotted lines in FIG. 4A to elevate the intermediate transfer belt 10.

FIG. 4B illustrates a state in which the rollers 74 are at the upper positions and the primary transfer nips are formed. FIG. 4C illustrates a state in which the rollers 74 are at the lower positions when primary transfer is not performed.

Figure 5A:
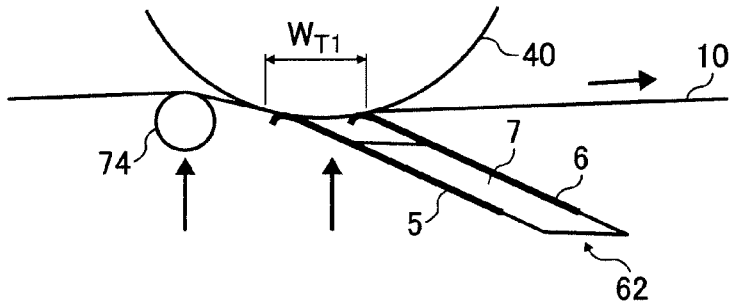
FIG. 5A is an illustration of a primary transfer region in the image forming apparatus of FIG. 1.
Figure 5B:
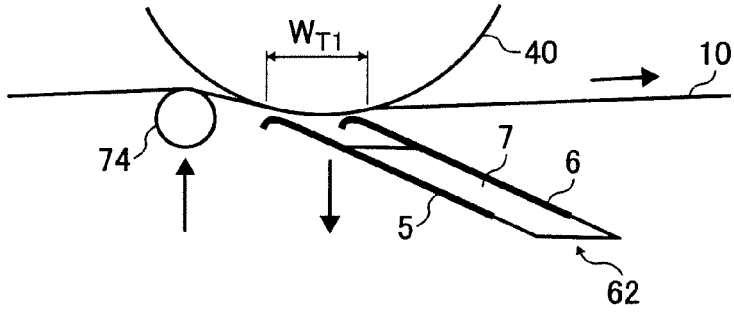
FIG. 5B is an illustration of the primary transfer region in the image forming apparatus of FIG. 1.

FIGS. 5A and 5B illustrate a primary transfer region in the image forming apparatus 100. The primary transferer 62 in each of the image forming units 18*k*, 18*y*, 18*m*, and 18*c* can include a primary transfer bias applicator 5, a bias applicator 6, and a holder 7. The bias applicator 6 can be placed downstream of the primary transfer bias applicator 5 in the rotation direction of the intermediate transfer belt 10. The bias applicator 6 can be placed at a downstream-end in the primary transfer nip. The primary transfer bias applicator 5 and the bias applicator 6 may be electrodes. As an exemplary embodiment, the two bias applicators are elastic and unified with the holder 7 that is a rigid body. The holder 7 can include an insulating spacer.

The primary transfer bias applicator 5 and the bias applicator 6 can contact the intermediate transfer belt 10 with a lower pressure in the primary transfer nip. The intermediate transfer belt 10 and the photoreceptor 40 form a mechanical nip (primary transfer nip) therebetween and may rotate in a similar direction. A length of the primary transfer nip is shown as $W_{T1}$.

The primary transfer bias applicator 5 and the bias applicator 6 can be apart from the intermediate transfer belt 10 as illustrate in FIG. 5B. In an exemplary embodiment, the length $W_{T1}$ of primary transfer nip does not change whether or not the primary transfer bias applicator 5 and the bias applicator 6 are in contact with the intermediate transfer belt 10.

Each of the primary transfer bias applicator 5 and the bias applicator 6 can be a rubber blade, a metal blade, or a resin bade. The primary transfer bias applicator 5 can apply a bias voltage having an opposite polarity to the toner charge polarity to the intermediate transfer belt 10 to transfer the toner image from the photoreceptor 40 to the intermediate transfer belt 10. The bias applicator 6 can apply a bias voltage having a same polarity as the toner charge polarity to the intermediate transfer belt 10 to prevent or limit a discharge phenomenon in the gap between the photoreceptor 40 and the intermediate transfer belt 10. Therefore, scattering and reverse transfer of toner can be reduced. As described above, pre-transfer scattering of toner can be reduced when the sheet is charged to the same polarity as the polarity of toner by the registration rollers 49.

When primary transfer bias applicator 5 and the bias applicator 6 are conductive elastic blades, the bias applicators can be held by the holder 7 that is a rigid body. By being held by the holder, the two bias applicators can be placed with a higher dimensional accuracy. Further, flexural deformation, deterioration of the two bias applicators due to wear, and frictional force to the intermediate transfer belt 10 can be reduced.

To reduce damage, wear, and deterioration of the intermediate transfer belt 10, an amount of the blade digging into the intermediate transfer belt 10 (digging amount) may be desirably maintained within a range from 0.1 mm to 0.5 mm. With the holder 7, the digging amount maybe kept within the desirable range. Further, a contact pressure to the intermediate transfer belt 10 may be kept under a maximum acceptable pressure that is 50 N/m in terms of linear pressure in a longitudinal direction of the blade. Therefore, unevenness in transfer characteristics can be reduced.

As a material for the blade, a known material (e.g. a rubber, a metal, and a resin) that can apply a required charge to the intermediate transfer belt 10 can be used. Alternatively, each of the primary transfer bias applicator 5 and the bias applicator 6 can be a conductive brush or a conductive small roller that may apply a required charge to the intermediate transfer belt 10.

As an example to produce a resin blade, carbon is added to a material, for example, urethane resin, silicon resin, and/or fluoroplastic and resistivity thereof is adjusted in a range from $10^6\Omega$ to $10^{13}\Omega$. The resistivity of the blade is desirably within a range from $10^6\Omega$ to $10^{10}\Omega$. As an example to produce a rubber blade, carbon is similarly added to a material, for example, chloroprene (CR) rubber, ethylene-propylene (EPDM) rubber, and/or Hydrin rubber. Resistivity thereof is adjusted to a similar level. The material can be shaped into a plate having a thickness within a range from 0.5 mm to 1.5 mm. Further, the blade can be configured so that polymer molecules flow in the rotation direction of the intermediate transfer belt 10 to reduce mechanical deterioration due to wear. Power sources (not shown) can apply voltages to the primary transfer bias applicator 5 and the bias applicator 6. Although details are not shown, a CPU, etc., may control the power sources.

Figure 6:
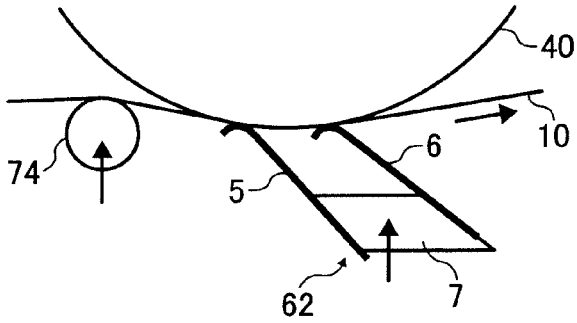
FIG. 6 is an enlarged illustration of the primary transfer region of FIG. 5A.

FIG. 6 is an enlarged illustration of the primary transferer 62. As illustrated in FIG. 6, a curved portion may be formed on each edge of the primary transfer bias applicator 5 and the bias applicator 6, which contact the intermediate transfer belt 10. Because of the curved contact portions, contact pressure to the intermediate transfer belt 10 may be equalized, which can prevent or reduce the wear and damage to the intermediate transfer belt 10.

The more desirable resistivity of the back surface of the intermediate transfer belt 10 is $10^9$ Ω/sq to $10^{11}$ Ω/sq, as described above. The shortest distance between the contact edges of the primary transfer bias applicator 5 and the bias applicator 6 on the back surface of the intermediate transfer belt 10 can be as small as 4 mm. When the back surface of the intermediate transfer belt 10 has a higher resistivity, a percentage of current flowing towards edge surfaces through the intermediate transfer belt 10 can be lower, even if the above distance between the two bias applicators is small, as described above. Therefore, effects of the bias applicators can be fully obtained. As a result, current flowing between the two bias applicators can be controlled and toner scattering can be reduced.

The intermediate transfer belt 10 can receive a higher load due to friction resistance when being in contact with the bias applicators and/or being rubbed by the cleaning member. A desirable load torque of the intermediate transfer belt 10 can be 1.0 newton meter (N·m) or less to achieve higher durability, even when the intermediate transfer belt 10 receives such a higher load. In an exemplary embodiment, the load torque is set to 0.3 N·m or less. The contact pressure of bias applicators to the intermediate transfer belt 10 may be kept to 20 newtons per square ($N/m^2$) or less and the friction coefficient between the friction surfaces may be kept to 0.5 or less, to achieve the above load torque. The friction coefficient may be achieved by applying a known lubricant agent to at least one of the friction surfaces.

Figure 7:
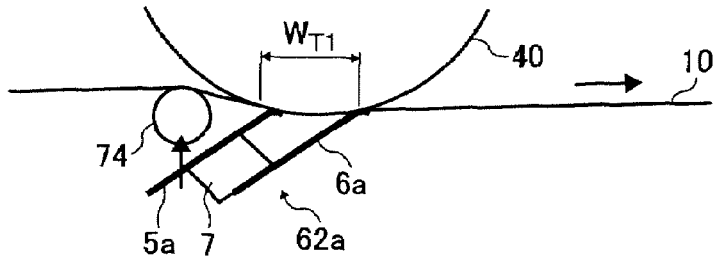
FIG. 7 is an illustration of a primary transfer region according to an exemplary embodiment.

FIGS. 7 to 12 illustrate variations of the primary transfer bias applicator and the bias applicator placed downstream of the transfer bias applicator in the primary transfer. FIG. 7 illustrates a primary transferer 62*a* including a primary transfer bias applicator 5*a* and a bias applicator 6*a*. The two bias applicators can be elastic members and unified with a holder 7. The primary transfer bias applicator 5*a* and the bias applicator 6*a* can include a metal thin plate including stainless steel (SUS), phosphor bronze, copper titanium alloy, and/or high copper beryllium alloy.

Figure 8:
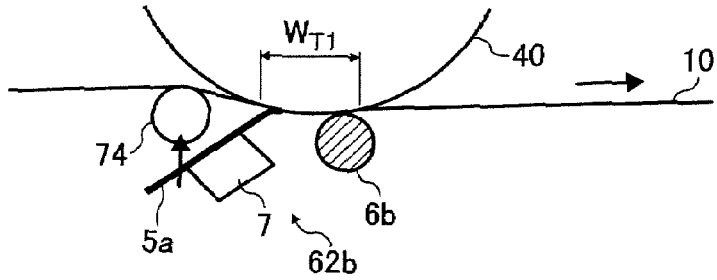
FIG. 8 is an illustration of a primary transfer region according to an exemplary embodiment.

FIG. 8 illustrates a primary transferer 62*b* including a primary transfer bias applicator 5*a* that is an elastic member and a bias applying roller 6*b* that is a bias applicator. The primary transfer bias applicator 5*a* is unified with a holder 7.

Figure 9:
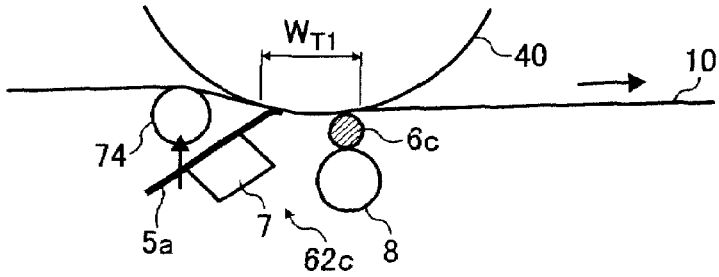
FIG. 9 is an illustration of a primary transfer region according to an exemplary embodiment.

FIG. 9 illustrates a primary transferer 62*c* including a primary transfer applicator 5*a* that is an elastic member and a bias applying roller 6*c*. The primary transfer bias applicator 5*a* is unified with a holder 7. When the bias applying roller 6*c* has a smaller diameter, a back-up roller 8 can be provided under the bias applying roller 6*c* to reduce unevenness of the contact pressure due to deformation.

Figure 10:
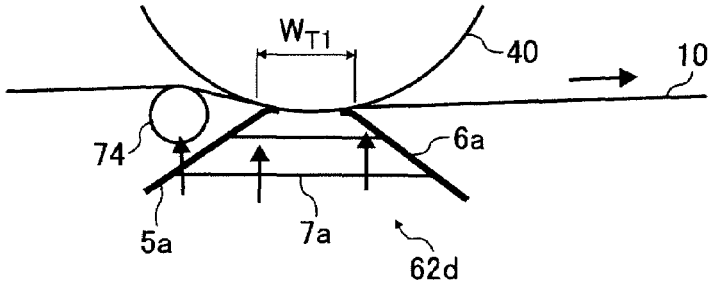
FIG. 10 is an illustration of a primary transfer region according to an exemplary embodiment.

FIG. 10 illustrates a primary transferer 62*d* including a primary transfer bias applicator 5*a* and a bias applicator 6*a* that are elastic members and are unified with a holder 7*a*. The curved portion of the upstream primary transfer bias applicator 5*a* curls in a trailing direction and the curved portion of the downstream bias applicator 6*a* curls in the opposite direction with respect to the rotation direction of the intermediate transfer belt 10. This configuration permits maintaining a larger insulating spacer in the holder 7*a* because the length $W_{T1}$ of the primary transfer nip is smaller in the primary transferer 62*d*.

Figure 11:
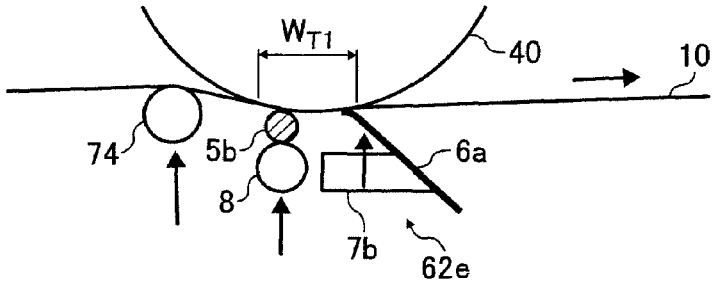
FIG. 11 is an illustration of a primary transfer region according to an exemplary embodiment.

FIG. 11 illustrates a primary transferer 62*e* including a primary transfer bias applying roller 5*b* that is the primary transfer bias applicator and a bias applicator 6*a*. The bias applicator 6*a* is an elastic member and is unified with a holder 7*b*. When the primary transfer bias applying roller 5*b* has a smaller diameter, a back-up roller 8 can be provided under the primary transfer bias applying roller 5*b*.

Figure 12:
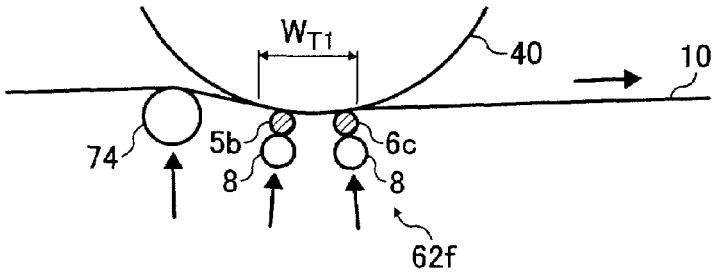
FIG. 12 is an illustration of a primary transfer region according to an exemplary embodiment.

FIG. 12 illustrates a primary transferer 62*f* including a primary transfer bias applying roller 5*b* and a bias applying roller 6*c*. When the primary transfer bias applying roller 5*b* and the bias applying roller 6*c* have smaller diameters, back-up rollers 8 can be provided under the bias applying rollers, respectively.

A similar effect is also available when each of the bias applicators is a brush.

Figure 13:
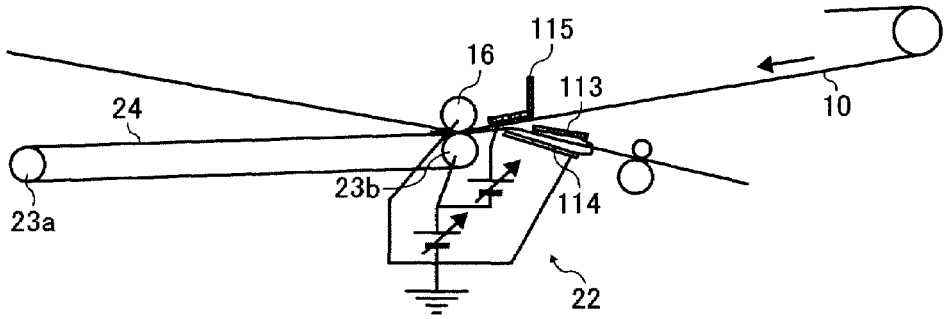
FIG. 13 is an illustration of a secondary transfer region according to an exemplary embodiment.

FIG. 13 illustrates the details of a secondary transfer region in the image forming apparatus 100. The secondary transferer 22 can further include a pair of entrance guides 113 and 114 and a pre-transfer prevention plate 115. The pre-transfer prevention plate 115 can be an electrode and can form an electric field to increase an electrostatic attraction between the toner and the primary transfer belt 10. The bias applying roller 23*b* is a secondary transfer bias applicator to apply a secondary transfer bias voltage to the intermediate transfer belt 10. The facing roller 16 and the pre-transfer prevention plate 115 can be in contact with the back surface of the intermediate transfer belt 10. A secondary transfer nip can be formed between the bias applying roller 23 band the facing roller 16 facing the bias applying roller 23*b*, via the intermediate transfer belt 10 and the secondary transfer belt 24. The pre-transfer prevention plate 115 can be placed upstream of the secondary transfer nip.

The entrance guides 113 and 114 can be plates and can guide the sheet sent from the registration rollers 49. The pre-transfer prevention plate 115 and the entrance guides 113 and 114 can help the sheet to contact the toner image on the intermediate transfer belt 10 upstream of the secondary transfer nip, to prevent the pre-transfer scattering of toner. The position at which the sheet starts to contact the toner image on the intermediate transfer belt 10 is defined as a contact start site. The pre-transfer prevention plate 115 can generate an electric field at the contact start site to prevent the toner image on the intermediate transfer belt 10 from scattering (pre-transfer scattering of toner). The electric field can enhance electrostatic attraction between the normally charged toner and the intermediate transfer belt 10.

The pair of the entrance guides 113 and 114 and the facing roller 16 can be maintained at a ground potential. In an exemplary embodiment, the normal charge polarity of toner is negative. The bias applying roller 23*b* and a pre-transfer prevention plate 115 can have a positive polarity potential, which is opposite to the polarity of the normal charge polarity of toner. It is desirable that the pre-transfer prevention plate 115 has a positive potential not less than the potential of the bias applying roller 23*b*.

Figure 14:
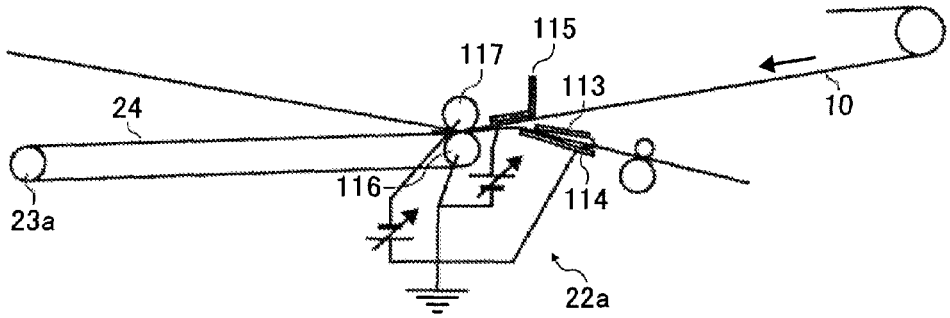
FIG. 14 is an illustration of a secondary transfer region according to an exemplary embodiment.

FIG. 14 illustrates a secondary transferer 22*a*. The secondary transferer 22*a* includes a roller 23*a*, a secondary transfer belt 24, a pair of entrance guides 113 and 114, a pre-transfer prevention plate 115, a facing roller 116, and a bias applying roller 117. The facing roller 116 can form a secondary transfer nip with the bias applying roller 117 via the intermediate transfer belt 10 and the secondary transfer belt 24. The pre-transfer prevention plate 115 and the bias applying roller 117 are in contact with the back surface of the intermediate transfer belt 10. The pair of entrance guides 113 and 114 and the facing roller 116 can be maintained at a ground potential. The bias applying roller 117 can receive the same polarity (negative) as the normal charge polarity of the toner. The pre-transfer prevention plate 115 can receive a potential of opposite polarity (positive) to the normal charge polarity of the toner.

Figure 15:
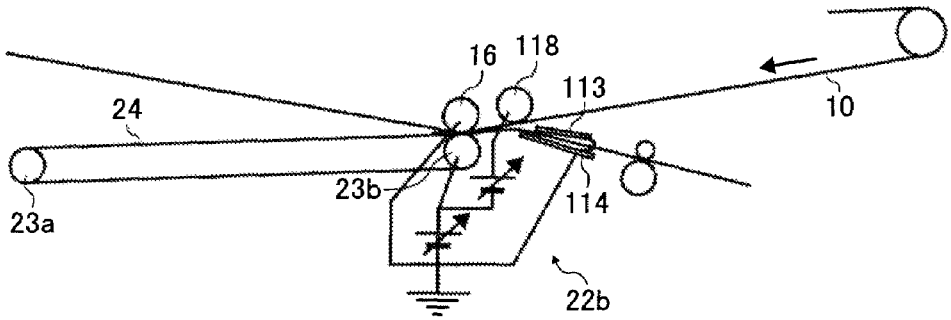
FIG. 15 is an illustration of a secondary transfer region according to an exemplary embodiment.

FIG. 15 illustrates a secondary transferer 22*b* having a similar configuration to the configuration of the secondary transferer 22 of FIG. 13. However, the pre-transfer prevention member is a roller. The secondary transferer 22*b* includes a facing roller 16, a roller 23*a*, a bias applying roller 23*b*, a secondary transfer belt 24, a pair of entrance guides 113 and 114, and a pre-transfer prevention roller 118.

The pair of the entrance guides 113 and 114 and the facing roller 16 can be maintained at a ground potential. The bias applying roller 23*b* and a pre-transfer prevention roller 118 can receive a potential whose polarity is opposite to the polarity of the normal charge polarity of the toner. It is desirable that the pre-transfer prevention roller 118 has a positive potential not less than the potential of the bias applying roller 23*b*.

Figure 16:
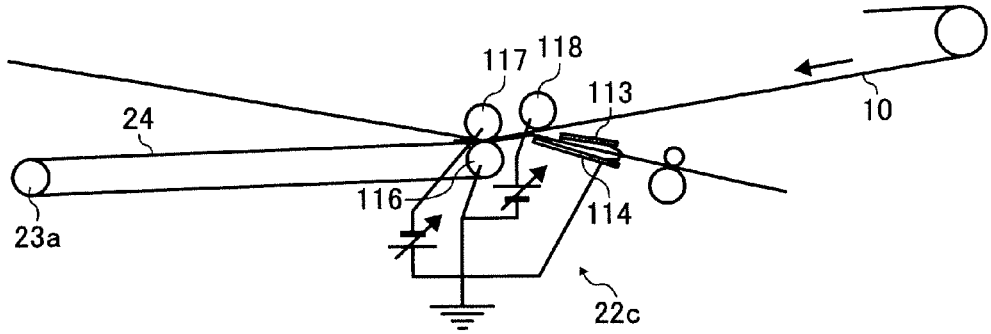
FIG. 16 is an illustration of a secondary transfer region according to an exemplary embodiment.

FIG. 16 illustrates a secondary transferer 22*c* having a similar configuration to the configuration of the secondary transferer 22*a* of FIG. 14. However, the pre-transfer prevention member is a roller. The secondary transferer 22*c* includes a roller 23*a*, a secondary transfer belt 24, a pair of entrance guides 113 and 114, a facing roller 116, a bias applying roller 117, and a pre-transfer prevention roller 118. The pair of entrance guides 113 and 114 and the facing roller 116 can be maintained at a ground potential. The bias applying roller 117 can have the same polarity potential (negative) as the normal charge polarity of toner. The pre-transfer prevention roller 118 can receive a potential of opposite polarity (positive) to the normal charge polarity of the toner.

Figure 17:
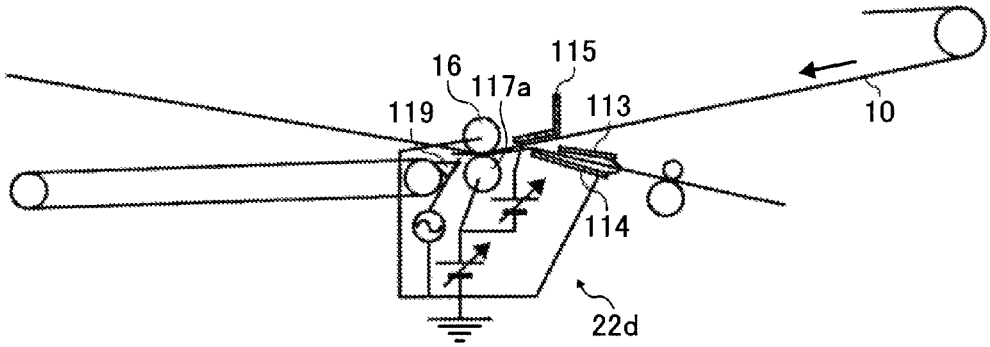
FIG. 17 is an illustration of a secondary transfer region according to an exemplary embodiment.

FIG. 17 illustrates a secondary transferer 22*d* that has a similar configuration to the configuration illustrated in FIG. 13. However, the secondary transferer 22*d* includes a discharger and does not include a secondary transfer belt. The secondary transferer 22*d* includes a facing roller 16, a bias applying roller 117*a*, a pair of entrance guides 113 and 114, a pre-transfer prevention plate 115, and a discharger 119. The bias applying roller 117*a* can contact the front surface of the intermediate transfer belt 10 and apply secondary transfer bias voltage to the intermediate transfer belt 10. The discharger 119 can be placed downstream of the secondary transfer nip and can discharge the sheet when the sheet is released from the intermediate transfer belt 10. A conveyer (not shown) conveys the sheet from the secondary transferer 22*d* to the fixer 25.

Figure 18:
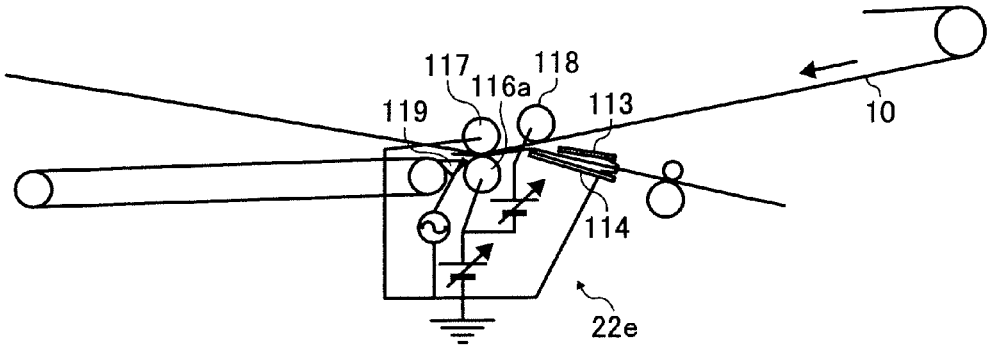
FIG. 18 is an illustration of a secondary transfer region according to an exemplary embodiment.

FIG. 18 illustrates a secondary transferer 22*e* that has a similar configuration to the configuration illustrated in FIG. 15. However, the secondary transferer 22*e* includes a discharger and a secondary transfer belt. The secondary transferer 22*e* includes a pair of entrance guides 113 and 114, a facing roller 116*a*, a bias applying roller 117, a pre-transfer prevention roller 118, and a discharger 119. The bias applying roller 117 contacting the back surface of the intermediate transfer belt 10 can apply a secondary transfer bias voltage thereto. The facing roller 116*a* faces the bias applying roller 117 via the intermediate transfer belt 10.

As described above, a plurality of bias applicators (electrodes) can be provided in the primary transfer nip in exemplary embodiments. The bias applicator 6 can apply a bias voltage having a same polarity as the polarity of the toner to the intermediate transfer belt 10, while a leak between the electrodes can be prevented. Therefore, the bias applicator 6 can reduce a discharge phenomenon in the gap between the photoreceptor 40 and the intermediate transfer belt 10 to reduce the scattering and/or reverse transfer of toner during the primary transfer.

In exemplary embodiments, an electric field to prevent toner transfer from the intermediate transfer belt 10 onto the recording medium can be formed in loose contact regions, upstream of the secondary transfer nip. The loose contact region means a region in which the recording medium is not in close contact with the intermediate transfer belt 10. Therefore, the pre-transfer prevention member can reduce the pre-transfer scattering of toner. Image quality defects due to discharge can be reduced by preventing the discharge phenomenon upstream and/or downstream of the transfer nips.

Further, the discharger 119 can prevent generation of electric field so that the toner image having the normal charge polarity on the intermediate transfer belt 10 is not transferred onto the recording medium in the loose contact region downstream of the secondary transfer nip. Therefore, the discharger 119 reduces toner scattering during the secondary transfer.

Further, the discharger 119 can effectively discharge the intermediate transfer belt 10 so that the toner image transferred onto the intermediate transfer belt 10 as primary transfer is not affected by the discharge phenomenon in the gap between the intermediate transfer belt 10 and the photoreceptor 40 placed ahead. Therefore, the reverse transfer and/or scattering of toner can be reduced.

Figure 19:
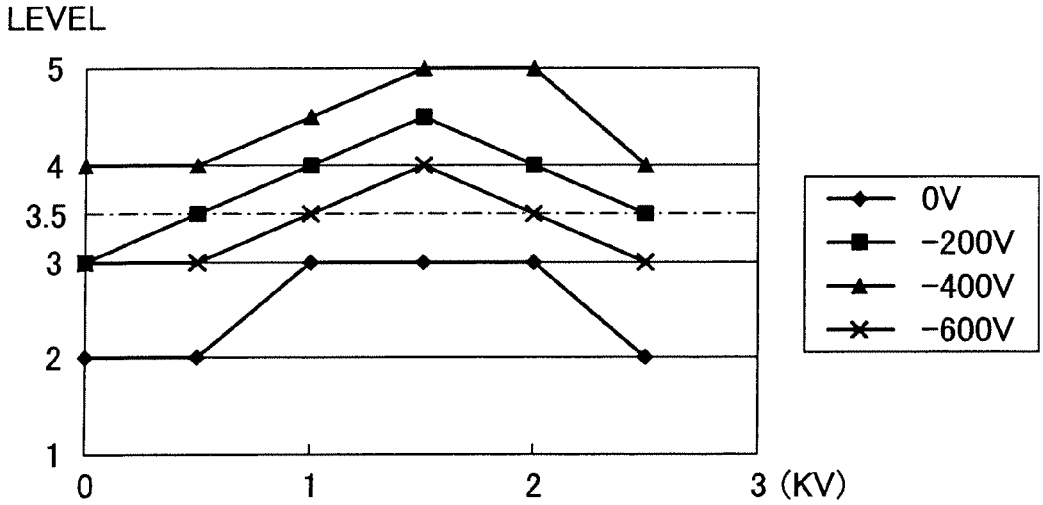
FIG. 19 is a graph showing a relation between toner scattering and bias voltages applied by bias applicators according to an exemplary embodiment.

FIG. 19 is a graph showing a relation between toner scattering, the bias voltage applied by the bias applicator in the primary transfer region (e.g. bias applicator 6 in FIG. 5A) and the bias voltage applied by the pre-transfer prevention member in the secondary transfer region (e.g. pre-transfer prevention plate 115 in FIG. 13.) To compare the toner scattering around a dot, a line, and/or a letter, toner images were transferred under different bias voltages and fixed on sheets. The voltage by the bias applicator was set to 0 V, −200 V, −400 V, and −600 V. The voltage by the pre-transfer prevention member was changed within a range from 0 kV to 2.5 kV.

In FIG. 19, the vertical scale is the scattering prevention level and the horizontal scale is the voltage applied by the pre-transfer prevention member. The higher the scattering prevention level, the less the toner scattering is observed. The lower limit of an acceptable scattering prevention level is determined as 3.5 and shown by a dotted line. The voltages applied by the bias applicator are shown as polygonal lines with different marks.

As shown in FIG. 19, the scattering prevention level was highest under the condition that the voltage by the bias applicator was −400 V and the voltage by the pre-transfer prevention member was within a range from 1.5 kV to 2.0 kV.

In the exemplary embodiments of FIG. 19, a normal paper having a thickness of 90 μm was used. The primary transfer bias voltage was set to 1.2 kV. The current flowing to the photoreceptor 40 from the current output from the bias power source can be about 25 μA, which can be substantially the same as the total output current from the bias power source. The secondary transfer bias voltage was set to 1.5 kV. The current flowing to the intermediate transfer belt 10 from the current output from the bias power source is about 40 μA, which can be substantially the same as the total output current from the bias power source.

Under the condition of exemplary embodiments of FIG. 19, a transfer rate of a high density solid portion of the image is 90 percent or greater. The transfer rate is a percentage of an amount of toner transferred onto the sheet divided by an amount of toner adhered on the photoreceptor 40 in the developing process.

The transfer current can decrease when the sheet has a higher resistivity and an increased thickness, which can decrease the transfer rate. The decrease in transfer rate can be better prevented when a constant current power source is used as the secondary transfer bias power source than in the case when a constant voltage power source is used. The constant current power source can include a limiter to limit maximum voltage and to facilitate balancing between the prevention of toner scattering and stable retention of a higher transfer rate.

For the bias voltage power source for the pre-transfer prevention member in the secondary transfer, a priority matter is the prevention of a discharge caused by excessive potential difference. Therefore, a constant voltage power source is more desirable than a constant current power source to reduce the toner scattering.

Further, amounts of electric current flowing in the secondary transfer region were measured. The electric current flowing between the electrode for the pre-transfer prevention member and the second transfer bias applicator is defined as a current C10. The electric current flowing between the secondary transfer bias applicator and the facing roller is defined as a current C12. Based on the results of the measurement, it is desirable that an absolute value of the current C10 is not greater than two-thirds of an absolute value of the current C12, to reduce toner scattering. It is more desirable that the absolute value of the current C10 is not greater than one-half of the absolute value of the current C12. Under the above conditions, the prevention of toner scattering and stable retention of a higher transfer rate can be balanced.

This application claims priority and contains subject matter related to Japanese Patent Application No. 2006-073655, filed on Mar. 17, 2006, the entire contents of which are hereby incorporated by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. An image forming apparatus including:

at least one image forming unit, comprising, an image carrier to which toner is applied to form a toner image, and a primary transfer bias applicator to apply a bias voltage, which has an opposite polarity to a normal charge polarity of the toner, to a primary transfer belt to transfer the toner image from the image carrier to the primary transfer belt;

wherein the primary transfer belt is configured to form a primary transfer nip with the image carrier; and a secondary transferer comprising, a secondary transfer nip configured to contact the toner image on the primary transfer belt via a recording medium, a secondary transfer bias applicator to form a secondary transfer electric field to transfer the toner image on the primary transfer belt on to the recording medium, and a facing member to face the second transfer bias applicator;

wherein the image forming apparatus further comprises:

a bias applicator to apply a bias voltage having a same polarity as the normal charge polarity of the toner to the primary transfer belt, in a position downstream of the primary transfer bias applicator in a rotation direction of the primary transfer belt, a contact start site at which the recording medium starts to contact the toner image, located upstream of the secondary transfer nip in the rotation direction of the primary transfer belt, and an electrode to form an electric field at the contact start site to increase an electrostatic attraction between the primary transfer belt and the toner having the normal charge polarity.

2. The image forming apparatus according to claim 1, wherein the toner image transferred from the image carrier to the primary transfer belt is a single color image or a multiple color image formed from plural image forming units.

3. The image forming apparatus according to claim 1, wherein the bias applicator is provided in the primary transfer nip.

4. The image forming apparatus according to claim 1, wherein the electrode contacts a back surface of the primary transfer belt.

5. The image forming apparatus according to claim 1, further comprising:

a discharger to discharge the recording medium when the recording medium is released from the primary transfer belt downstream of the secondary transfer nip in the rotation direction of the primary transfer belt.

6. The image forming apparatus according to claim 1, wherein the back surface of the primary transfer belt has a surface resistivity not less than $10^9$ ohms per square.

7. The image forming apparatus according to claim 1, wherein an absolute value of current flowing between the secondary transfer bias applicator and the facing member is greater than an absolute value of current flowing between the electrode and the secondary transfer bias applicator during secondary transferring.

8. The image forming apparatus according to claim 1, further comprising:

a constant current power source to supply power to the secondary transfer bias applicator during secondary transferring.

9. The image forming apparatus according to claim 1, further comprising:

a constant voltage power source to supply power to the electrode.

* * * * *